US010240722B2

(12) United States Patent
Popadiuc

(10) Patent No.: US 10,240,722 B2
(45) Date of Patent: Mar. 26, 2019

(54) CRYOGENIC FLUID SYSTEM AND METHOD OF OPERATING SAME

(71) Applicant: Progress Rail Locomotive Inc., LaGrange, IL (US)

(72) Inventor: Peter Popadiuc, Bensenville, IL (US)

(73) Assignee: Progress Rail Locomotive Inc., LsGrange, IL (US)

( * ) Notice: Subject to any disclaimer, the term of this patent is extended or adjusted under 35 U.S.C. 154(b) by 326 days.

(21) Appl. No.: 15/333,129

(22) Filed: Oct. 24, 2016

(65) Prior Publication Data

US 2018/0112826 A1 Apr. 26, 2018

(51) Int. Cl.

*F17C 13/00* (2006.01)
*F17C 13/08* (2006.01)
*F04B 23/02* (2006.01)

(52) U.S. Cl.

CPC ..... *F17C 13/001* (2013.01); *F04B 23/021* (2013.01); *F17C 13/083* (2013.01); *F17C 2225/0161* (2013.01); *F17C 2227/0135* (2013.01)

(58) Field of Classification Search

CPC ..... F17C 9/04; F17C 2227/0135–2227/015; F17C 2227/0178; F04B 15/08; F04B 23/021

See application file for complete search history.

(56) References Cited

U.S. PATENT DOCUMENTS 2,018,144 A * 10/1935 Mesinger ..... F04B 5/02 137/339
3,422,765 A * 1/1969 Schoch ..... F04B 1/02 310/90.5
4,365,942 A 12/1982 Schmidt
4,418,544 A 12/1983 Heybutzki et al.
4,421,464 A * 12/1983 Schmidt ..... F04B 15/08 310/27
5,566,712 A * 10/1996 White ..... B61C 5/00 137/587
6,129,529 A 10/2000 Young et al.
6,203,288 B1 3/2001 Kottke
6,283,720 B1 9/2001 Kottke
6,354,087 B1 * 3/2002 Nakahara ..... F17C 13/02 62/6
6,481,218 B1 * 11/2002 Drelser ..... B60K 15/03006 62/50.6
6,506,030 B1 1/2003 Kottke
6,722,866 B1 4/2004 Dresler (Continued)

FOREIGN PATENT DOCUMENTS

CN 102594087 7/2012
CN 103441648 7/2015

(Continued)

*Primary Examiner* — Tareq Alosh
(74) *Attorney, Agent, or Firm* — Mattingly Burke Cohen & Biederman

(57) ABSTRACT

A cryogenic fluid system includes a vessel and a pumping system positioned for submerging within cryogenic fluid within the vessel. The pumping system includes an electric drive structured to move a pumping element within a pumping chamber to pump cryogenic fluid out of the vessel. A cooling jacket forms a heat exchange cavity about the electric drive such that heat is rejected externally of the storage vessel.

18 Claims, 3 Drawing Sheets

(56) References Cited

U.S. PATENT DOCUMENTS

| | | | | |
|---|---|---|---|---|
| 7,416,548 | B2 * | 8/2008 | Baust | A61B 18/02 606/20 |
| 7,750,513 | B2 | 7/2010 | Witte et al. | |
| 9,206,802 | B2 | 12/2015 | Dalziel et al. | |
| 2005/0016185 | A1 * | 1/2005 | Emmer | F17C 5/007 62/50.1 |
| 2009/0165640 | A1 | 7/2009 | Kawasaki et al. | |
| 2015/0143822 | A1 | 5/2015 | Chalmers et al. | |
| 2015/0276133 | A1 * | 10/2015 | Ollweiler | F17C 13/00 220/560.04 |
| 2016/0146199 | A1 | 5/2016 | Pollard et al. | |
| 2016/0201659 | A1 | 7/2016 | Nelson et al. | |
| 2016/0215766 | A1 | 7/2016 | Brown et al. | |

FOREIGN PATENT DOCUMENTS

| | | |
|---|---|---|
| CN | 105422413 | 3/2016 |
| DE | 102008011456 | 9/2009 |
| DE | 10200801667 | 10/2009 |
| WO | 2009025505 | 2/2009 |
| WO | 2015184537 | 12/2015 |

* cited by examiner

CRYOGENIC FLUID SYSTEM AND METHOD OF OPERATING SAME

TECHNICAL FIELD

The present disclosure relates generally to cryogenic fluid systems, and more particularly to a cryogenic fluid system having a submerged pumping system with a cooling jacket.

BACKGROUND

Cryogenic fluid systems are used in a wide variety of applications, commonly where transport and handling of a material in a liquid state rather than a gaseous state is desired. In recent years, cryogenic fluid systems in the field of internal combustion engines have received increasing interest. Combustible hydrocarbon fuels such as liquefied natural gas (LNG), liquid propane (LP), and still others are known to provide certain advantages over traditional hydrocarbon fuels such as gasoline and diesel, notably with respect to emissions. Economics and resource availability are also factors driving increased attention to technology in this area.

In a typical design a vessel contains a liquefied fuel such as LNG, and is equipped with an apparatus such as a vaporizer or evaporator to transition the fuel from a liquid form to a gaseous form for supplying to cylinders in an engine for combustion. Various systems have been proposed that provide submerged or partially submerged pumps to convey the cryogenic liquid fuel from the storage vessel to the vaporizer equipment. Various challenges are attendant to operating pumps and the like inside of a closed cryogenic storage vessel, however, U.S. Pat. No. 6,129,529 relates to a submersible motor driven pump and drive coupling, with the pump being designed so that liquefied petroleum gas is passed through a motor assembly to cool and lubricate the motor assembly.

SUMMARY OF THE INVENTION

In one aspect, a cryogenic fluid system includes a cryogenic fluid storage vessel having a cryogenic fluid outlet formed therein, and a pumping system positioned within the cryogenic fluid storage vessel. The pumping system includes a housing having a pumping inlet fluidly connected with an interior volume of the cryogenic fluid storage vessel, a pumping outlet structured to fluidly connect with the cryogenic fluid outlet, and a pumping chamber fluidly between the pumping inlet and the pumping outlet. The pumping system further includes a pumping element movable within the pumping chamber to transition cryogenic fluid from the pumping inlet to the pumping outlet, and an electric drive structured to actuate the pumping element. The pumping system further includes a cooling jacket forming a heat exchange cavity about the electric drive for conveying cryogenic fluid in heat transference contact with the electric drive.

In another aspect, a machine system includes a machine, and a storage vessel structured to contain a fluid. The machine system further includes fluid coupling hardware including a fluid conduit for conveying the fluid in a gaseous or liquid form from the storage vessel to the machine, and a pumping system positioned within the storage vessel. The pumping system includes a housing having a pumping inlet, a pumping outlet structured to fluidly connect with the fluid conduit and a pumping chamber. The pumping system further includes a pumping element movable within the pumping chamber to transition the fluid from the pumping inlet to the pumping outlet, and an electric drive structured to actuate the pumping element. The pumping system further includes a cooling jacket forming a heat exchange cavity about the electric drive for conveying the fluid in heat transference contact with the electric drive.

In still another aspect, a method of operating a cryogenic fluid system includes operating a pumping system submerged in cryogenic fluid within a storage vessel to transition cryogenic fluid from the storage vessel to a fluid conduit outside the storage vessel that is structured to supply the fluid to a machine. The method further includes conveying cryogenic fluid transitioned by way of the operating of the pumping system through a heat exchange cavity formed by a cooling jacket positioned about an electric drive of the pumping system, such that the cryogenic fluid exchanges heat with the electric drive. The method still further includes conveying the cryogenic fluid having exchanged heat with the electric drive out of the storage vessel.

DETAILED DESCRIPTION

Figure 1:
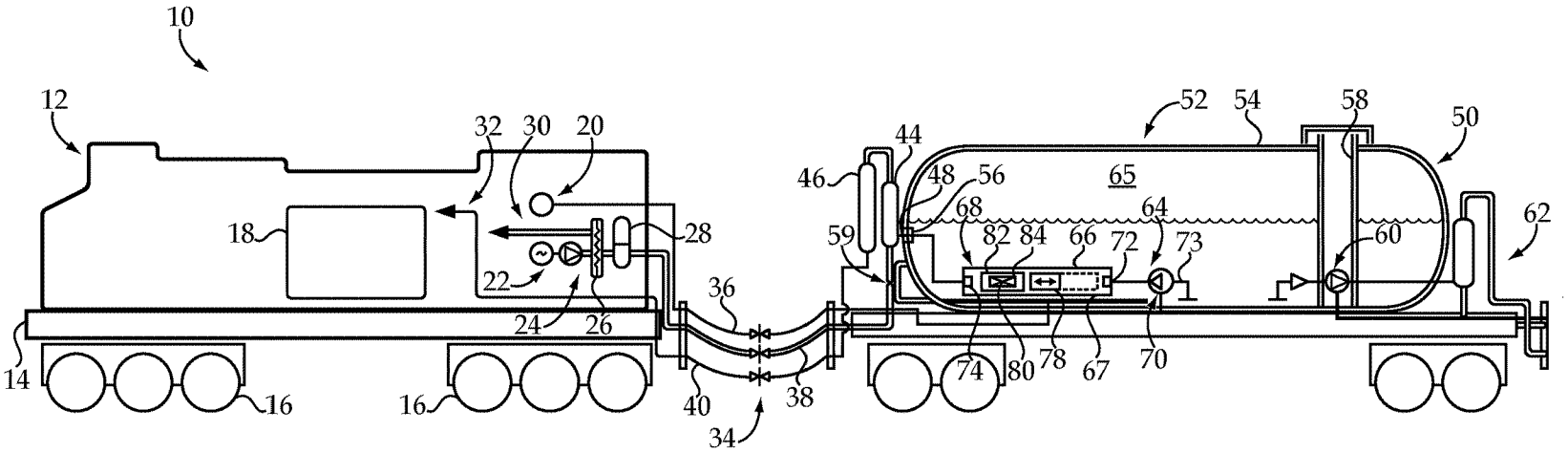
FIG. 1 is a side diagrammatic view of a machine system, according to one embodiment.

Referring to FIG. 1, there is shown a machine system 10 according to one embodiment, and including a machine 12 having a frame 14 supported by a plurality of rolling elements 16, at least some of which can be traction elements structured for applying traction power to a ground surface or rails. In a practical implementation strategy, machine 12 includes a locomotive, however, the present disclosure is not limited to locomotive or rail applications, or to a mobile machine or machine system at all, for reasons which will be further apparent from the following description. Machine 12 may include a combustion engine 18 such as a gaseous fuel internal combustion engine operated by way of diesel pilot ignition, although the present disclosure is not thereby limited. Engine 18 might be part of a genset, such that operation of engine 18 provides rotational power for rotating parts in a generator (not shown) that is part of or coupled with an electrical system 20 of machine system 10. A generator operated in this manner could be coupled with traction motors structured to drive rolling elements 16, in a generally conventional manner. Engine 18 could also be operated to directly drive rolling elements 16 by way of suitable mechanical apparatus. Machine system 10 may also include a cryogenic fluid system 52, in the illustrated case mounted upon a tender car 50 that is coupled with and towed by machine 12, having details and features further discussed herein. As will be further apparent from the following description, features and operating capabilities of cryogenic fluid system 52 are considered to provide various advantages over conventional machine systems in the rail context, and elsewhere. Cryogenic fluid system 52 may include or be a part of a fuel system of machine system 10, for fueling engine 18 to propel machine 12 and any associated rail cars or the like, and provide operational power for machine system 10 generally. In other contexts, cryogenic fluid system 52 could be used in a marine application or a stationary application, such as for operating a stationary genset, a pump, a compressor, or in various manufacturing or industrial settings that are altogether different from electric power generation.

Machine system 10 may further include a glycol system 22 including a pump 24, a heat exchanger or radiator 26 and an expansion tank 28, that operate to circulate glycol or another heat exchange fluid to a vaporizer 44 for vaporizing stored cryogenic fluid pumped from cryogenic storage vessel 54. Glycol flow 30 to and from engine 18 is shown. A fuel flow 32 from fuel conduit 40 to engine 18 is also shown. Fluid coupling hardware 34, including a fuel conduit 40 and a glycol conduit 38, extends between machine 12 and tender car 50 in a generally conventional manner. An electrical conduit 36 likewise extends between machine 12 and tender car 50. Mounted upon tender car 50 is vaporizer 44, coupled by an outlet conduit 48 to a cryogenic fluid outlet 56 of a cryogenic fluid storage vessel 54 of cryogenic fluid system 52. From vaporizer 44 cryogenic fluid, such as cryogenic fuel, can be converted to a gaseous state and fed to or past an accumulator 46 that in turn is fluidly coupled by way of fluid coupling hardware 34 to provide fuel flow 32 to engine 18.

In the illustrated embodiment, cryogenic fluid system 52 further includes a service port 59 and a cold well 58 each formed in cryogenic fluid storage vessel 54. A pumping system 60 may be positioned at least partially within cold well 58, and coupled with distribution and supply equipment 62 for providing fluid, typically converted to gaseous form, to other locations or devices in machine system 10. Pumping system 60 may be a low pressure pumping system adapted for supplying stored fluid to a system, such as another locomotive, that is not equipped for handling or operating with high pressure fluid. Another pumping system 64, which can be considered a first pumping system for purposes of the present description, is positioned within cryogenic fluid storage vessel 54, and may be positioned adjacent to service port 59. In a further practical implementation strategy, pumping system 64 may be mounted upon a mount in the nature of a rail 67 positioned upon a bottom floor of cryogenic fluid storage vessel 54. Service personnel can access pumping system 64 by way of service port 59, and pumping system 60 can be accessed by way of cold well 58.

Pumping system 64 may further include a first pumping mechanism 68 and a second pumping mechanism 70. Pumping mechanism 70 may include a low-pressure pumping mechanism structured to transition stored cryogenic fluid from an interior volume 65 of cryogenic fluid storage vessel 54 to pumping mechanism 68 which serves as a high-pressure pumping mechanism. Pumping system 64 may further include a housing 66 having a pumping inlet 72 and/or 73 fluidly connected with interior volume 71. For purposes of the present description, either of pumping inlet 72 and pumping inlet 73, associated with pumping mechanism 68 and pumping mechanism 70, respectively, can be understood as a pumping inlet to housing 66. Housing 66 may further include a pumping outlet 74 structured to fluidly connect with cryogenic fluid outlet 56, and a pumping chamber 76 fluidly between pumping inlet 72, 73 and pumping outlet 74. Pumping system 68 also includes a pumping element 78 movable within pumping chamber 76 to transition cryogenic fluid from pumping inlet 72, 73 to pumping outlet 74. While only a single pumping element 78 is shown in FIG. 1, in many instances a dual-piston pump will be employed, such as one of the dual piston designs further discussed herein. An electric drive 80 of pumping system 68 is structured to actuate pumping element 78. Pumping system 64 further includes a cooling jacket 82 forming a heat exchange cavity 84 about electric drive 80, for conveying cryogenic fluid in heat transference contact with electric drive 80.

Figure 2:
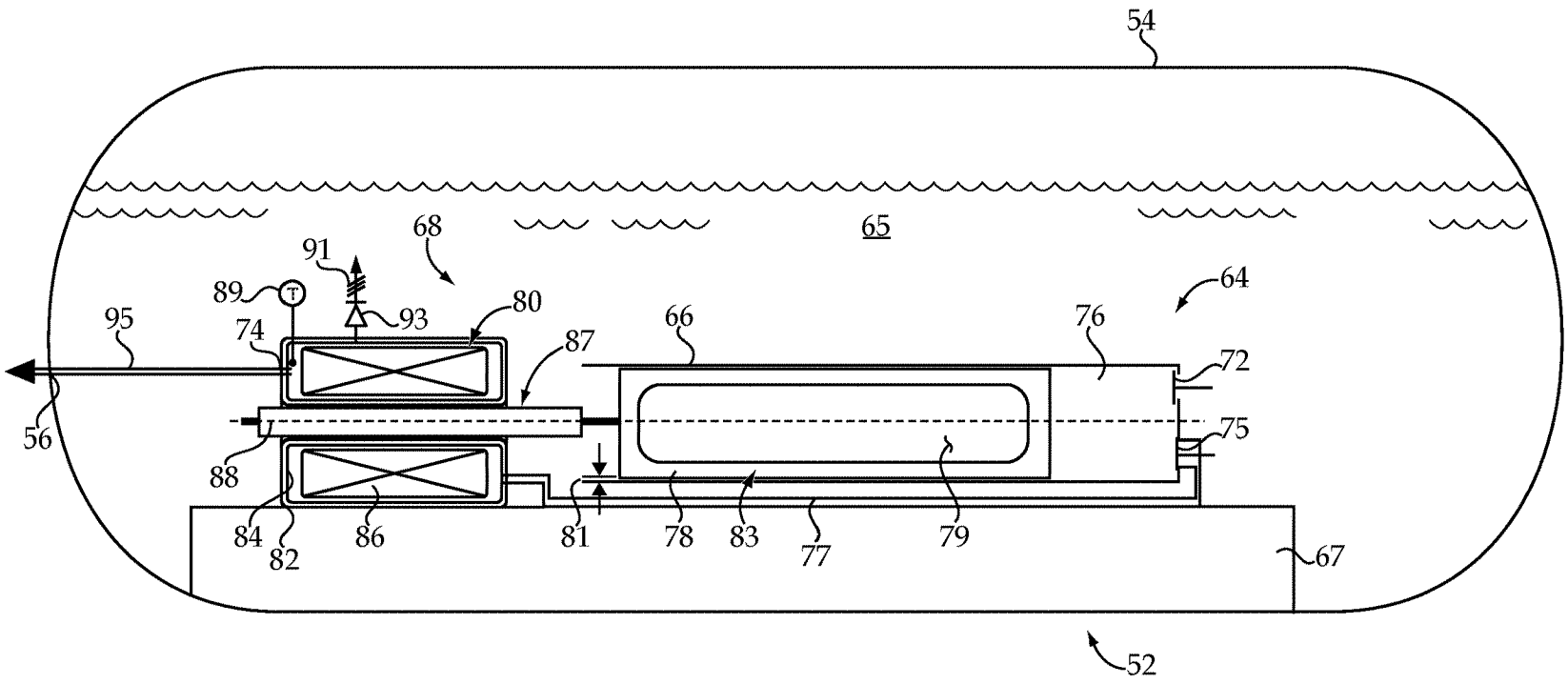
FIG. 2 is a side diagrammatic view of a cryogenic fluid system suitable for use in the machine system of FIG. 1.

Referring also now to FIG. 2, there are shown additional details of cryogenic fluid system 52. As noted above, pumping system 64 includes an electric drive 80 structured to actuate pumping element 78. In a practical implementation strategy, electric drive 80 includes a first electromagnetic element 86 and a second electromagnetic element 88 inductively coupled with first electromagnetic element 86. Cooling jacket 82 may envelop first electromagnetic element 86 but not second electromagnetic element 88. First electromagnetic element 86 may include one or more conductive coils, positioned to extend circumferentially around second electromagnetic element 88. First electromagnetic element 86 may include a fixed electromagnetic element, and second electromagnetic element 88 may include a movable electromagnetic element. Second electromagnetic element 88 may include permanent magnets.

Those skilled in the art will appreciate from the illustration of FIG. 2 that electric drive 80 may have the form of a linear electric motor, and pumping element 78 may include a piston coupled to reciprocate with the linear electric motor. In the illustrated embodiment, pumping element 78 moves back and forth with the back and forth movement of second electromagnetic element 88, responsive to changes in an electrical energy state of first electromagnetic element 86, in a generally conventional manner. According to the FIG. 2 illustration, pumping element 78 moves to the left to draw cryogenic fluid from volume 65 into pumping chamber 76 by way of pumping inlet 72, and moves to the right to increase a pressure of the cryogenic fluid in pumping chamber 76 and expel the cryogenic fluid out through a pumping chamber outlet. Each of inlet 72 and outlet 75 may be equipped with an appropriately oriented check valve in a practical implementation strategy. The pumped cryogenic fluid travels from pumping chamber 76 into a fluid conduit 77. It can be seen from FIG. 2 that fluid conduit 77 connects to heat exchange cavity 84 formed by cooling jacket 82. Electric drive 80 will generally remain fixed in position mounted to rail 67, while piston or pumping element 78 reciprocates within housing 66. In the illustrated embodiment, first electromagnetic element 86 extends circumferentially around second electromagnetic element 88, and can be understood as positioned radially outward of second electromagnetic element 88. In other embodiments, a linear electric motor could be structured so that the movable "rotor" is positioned radially outward of the fixed "stator," approximately the opposite of what is depicted in the embodiment of FIG. 2. In still other embodiments, a different type of motor such as a rotating motor could be employed.

As noted above, pumping element 78 reciprocates within housing 66. A relatively tight clearance 81 extends radially between housing 66 and pumping element 78. An internal cavity 79 may be formed in pumping element 78. It should be appreciated that clearance 81 might be only a few microns, but need not be entirely leak-proof given that pumping system 64 is submerged. In other words, a relatively minor amount of leakage can be well tolerated. A bearing surface 83 is identified and includes an outer peripheral surface of pumping element 78. Pumping element 78 and housing 66 may be formed of materials capable of dry lubrication or self-lubrication, suited to the cryogenic submerged environment. Second electromagnetic element 88 also includes an outer bearing surface 87 that may be analogously dry lubricated or self-lubricating. It can further be seen from FIG. 2 that cooling jacket 82 extends between first electromagnetic element 86 and second electromagnetic element 88, and can be formed of or coated with material suitable for dry lubrication or self-lubrication at the interface with bearing surface 87. Alternatively, cryogenic fluid resident within volume 65 could provide lubrication between pumping element 78 and housing 66 and/or between second electromagnetic element 88 and cooling jacket 82 or other such parts of electric drive 80 as needed. It will be recalled that first electromagnetic element 86 extends circumferentially around second electromagnetic element 88, and may therefore be generally cylindrical. Analogously, cooling jacket 82 may extend circumferentially around second electromagnetic element 88, and has a generally cylindrical configuration. Alterations to the illustrated embodiment, such as shortening an axial length of cooling jacket 82 might render a more squat and/or toroidal form, nevertheless still understood as generally cylindrical. In other instances, altogether different geometry of electric drive 80 and/or cooling jacket 82 could be employed, as alluded to above. FIG. 2 also illustrates a temperature sensor 89 structured to sense a temperature of cryogenic fluid within heat exchange cavity 84, and a pressure venting conduit 91 coupled to cooling jacket 82 and having a pressure relief valve 93 within pressure venting conduit 91. Pressure relief valve 93 might be a one-way valve structured to open to enable some cryogenic fluid to be vented either into volume 65 or to atmosphere. Those skilled in the art will appreciate the general desirability and need to manage heat and reject heat produced by way of operating pumping system 64 in the enclosed and contained environment within cryogenic fluid storage vessel 54. Strategies have been proposed that appear to suggest cryogenic fluid can itself be used as a coolant and lubricant to reject heat produced by way of pump operation, as discussed above. The present disclosure provides advantages over such strategies in the manner in which heat is rejected, however, and the general construction of pumping system 64 and other pumping systems contemplated herein.

To this end, cryogenic fluid system 52 may be structured so that heat exchange cavity 84 is positioned fluidly between pumping inlet 72, 73 and pumping outlet 74. It can be seen from FIG. 2 that pumped cryogenic fluid from fluid conduit 77 is conveyed into heat exchange cavity 84 and thenceforth into fluid conduit 95 and to cryogenic fluid outlet 56. Cryogenic fluid transitioned by way of operating pumping system 64 is conveyed through heat exchange cavity 84 to exchange heat with electric drive 80. As noted above, energizing first electromagnetic element 86 can produce heat which, unless rejected from cryogenic fluid storage vessel 54, would eventually increase the temperature within volume 65 and necessitate venting or creating other problems. In this general manner, heat can be rejected in such a way that other temperature control or pressure venting is unnecessary most or all of the time. Pumping mechanism 68 may include a high-pressure pumping mechanism, and pumping mechanism 70 may include a low-pressure pumping mechanism. Pumping system 60 may also be a low-pressure pumping system at least in comparison with pumping system 64, although the present disclosure is not thereby limited. In the embodiment illustrated in FIG. 2, the high-pressure cryogenic fluid is conveyed from pumping chamber 76 through cooling jacket 82. In alternative embodiments, a low-pressure pumping mechanism can provide the cryogenic fluid for cooling an electric drive.

Figure 3:
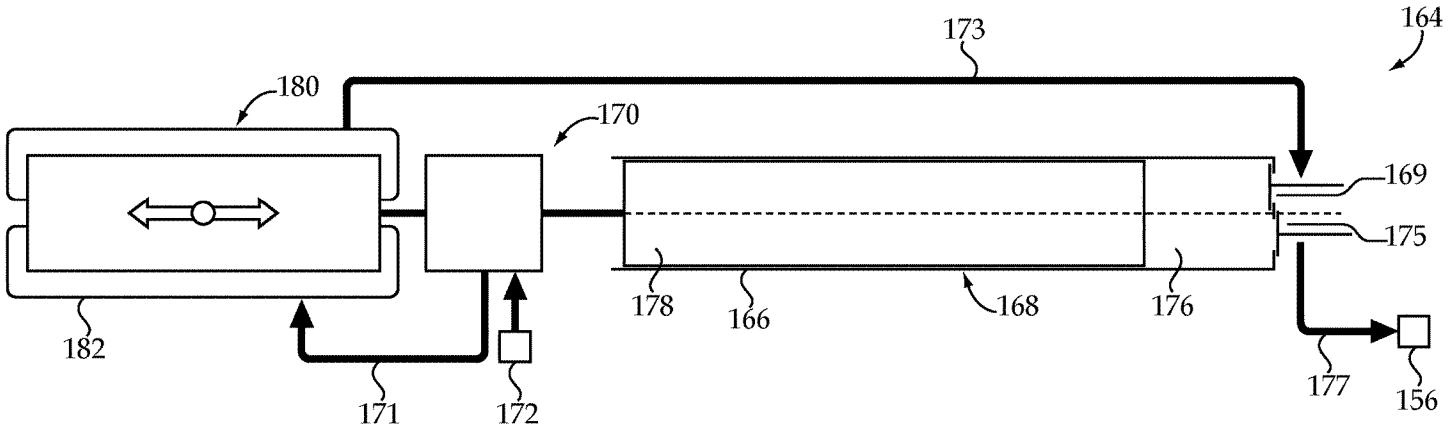
FIG. 3 is a side diagrammatic view of a pumping system, according to one embodiment.

Referring now to FIG. 3, there is shown a pumping system 164 including certain additional features along these lines. In pumping system 164, a pumping mechanism 168 includes a pumping element 178 movable within a housing 166 to pressurize cryogenic fluid in a pumping chamber 176. Cryogenic fluid may be drawn into pumping chamber 176 by way of a pumping inlet 169, and discharged by way of a pumping outlet 175 to a fluid conduit 177 that feeds a cryogenic fluid outlet 156 of a cryogenic fluid storage vessel (not shown). A fluid conduit 173 feeds the cryogenic fluid to pumping inlet 169. Pumping mechanism 168 may include a high-pressure pumping mechanism. Rather than supplying high-pressure pumping mechanism 168 with cryogenic fluid directly from a low-pressure pump, a low-pressure pumping mechanism 170 provides cryogenic fluid first to a cooling jacket 182 positioned about an electric drive 180, and the fluid is then conveyed to pumping mechanism. Low-pressure pumping mechanism 170 may operate to draw cryogenic fluid into an inlet 172, and then convey the cryogenic fluid by way of a fluid conduit 171 to a cooling jacket 182, and thenceforth feed the cryogenic fluid to fluid conduit 173. In addition to the different plumbing configuration, in the embodiment of FIG. 3 it can be seen that each of low-pressure pumping mechanism 170 and high-pressure pumping mechanism 168 is actuated by way of the same electric drive 180. Reciprocation of a movable electromagnetic element in electric drive 180 can reciprocate pumping element 178, and also a pumping element (not shown) such as a piston of pumping mechanism 170.

Figure 4:
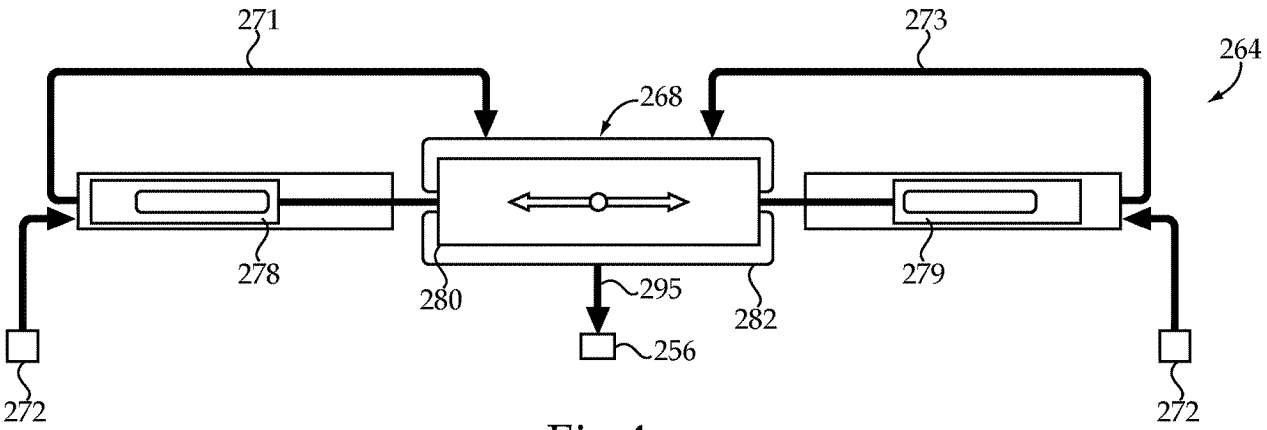
FIG. 4 is a side diagrammatic view of a pumping system according to another embodiment.

Referring to FIG. 4, there is shown another pumping system 264 having still another configuration. In pumping system 264, a first pumping element or piston 278 is positioned upon one side of an electric drive 280 and a second pumping element 279 or piston is positioned upon an opposite side of electric drive 280. A cooling jacket 282 is positioned about electric drive 280. Reciprocation of pumping elements 278 and 279 can draw cryogenic fluid into pumping inlet(s) 272 and convey the pumped cryogenic fluid to fluid conduits 271 and 273 that feed the cryogenic fluid to cooling jacket 282 of a common pumping mechanism 268. Once electric drive 280 of pumping mechanism 268 is cooled, the cryogenic fluid, having exchanged heat with electric drive 280, is conveyed to a fluid conduit 295, and thenceforth a cryogenic fluid outlet 256 of a cryogenic fluid storage vessel (not shown).

INDUSTRIAL APPLICABILITY

Referring back to FIG. 2, cryogenic fluid system 52 is shown as it might appear where pumping element 78 has just completed an intake stroke within pump housing 66, and fluid has been drawn into pumping chamber 76. Pumping system 64 can be operated while submerged in the cryogenic fluid to transition cryogenic fluid from storage vessel 54 to a fluid conduit outside storage vessel 54 structured to supply the fluid to a machine such as machine 12. As discussed herein, when pumping element 78 moves to the right as electric drive 80 is energized or deenergized appropriately, cryogenic fluid may be urged out of pumping chamber 76 and into heat exchange cavity 84 by way of fluid conduit 77. Within heat exchange cavity 84, the pumped cryogenic fluid exchanges heat with electric drive 80. Continued pumping or operation of pumping system 64 will urge additional cryogenic fluid through heat exchange cavity 84, through fluid conduit 95 and out of cryogenic fluid outlet 56. Meanwhile, temperature sensor 89 can monitor a temperature of cryogenic fluid within heat exchange cavity 84, with valve 93 operating either autonomously/automatically, or potentially by way of direct control to vent cryogenic fluid via venting conduit 91, if temperature and/or pressure conditions within heat exchange cavity 84 so justify. From the foregoing description it will also be appreciated that the conveying of cryogenic fluid through heat exchange cavity 84 and otherwise from pumping chamber 76 to cryogenic fluid outlet 56 and outside of storage vessel 54 can occur in isolation from contact with any bearing surfaces of electric drive 80 and any bearing surfaces of pumping element 78. Operation in this general manner described above can be understood to analogously apply to the other embodiments contemplated herein.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims.

What is claimed is:

1. A cryogenic fluid system comprising:

a cryogenic fluid storage vessel having a cryogenic fluid outlet formed therein;

a pumping system positioned within the cryogenic fluid storage vessel, and including a housing having a pumping inlet fluidly connected with an interior volume of the cryogenic fluid storage vessel, a pumping outlet structured to fluidly connect with the cryogenic fluid outlet, and a pumping chamber fluidly between the pumping inlet and the pumping outlet;

the pumping system further including a pumping element movable within the pumping chamber to transition the cryogenic fluid from the pumping inlet to the pumping outlet, and an electric drive structured to actuate the pumping element; and the pumping system further including a cooling jacket forming a heat exchange cavity about the electric drive for conveying the cryogenic fluid in heat transference contact with the electric drive;

wherein the cooling jacket is disposed separately from the pumping chamber and the heat exchange cavity is positioned fluidly between the pumping inlet and the pumping outlet, such that the cryogenic fluid transitioned from the pumping inlet and pumping chamber is conveyed through the heat exchange cavity to exchange heat with the electric drive prior to being transitioned to the pumping outlet.

2. The system of claim 1 wherein the electric drive includes a first electromagnetic element and a second electromagnetic element inductively coupled with the first electromagnetic element, and the cooling jacket envelops the first electromagnetic element but not the second electromagnetic element.

3. The system of claim 2 further comprising a vaporizer and an outlet conduit coupling the cryogenic fluid outlet to the vaporizer.

4. The system of claim 2 wherein the electric drive includes a linear electric motor, and the pumping element includes a piston coupled to reciprocate with the linear electric motor.

5. The system of claim 4 wherein the first electromagnetic element includes a fixed electromagnetic element, and the second electromagnetic element includes a movable electromagnetic element.

6. The system of claim 5 wherein the cooling jacket extends between the fixed electromagnetic element and the movable electromagnetic element, and has a cylindrical configuration.

7. The system of claim 5 further comprising a second piston coupled to reciprocate with the linear electric motor, and movable within a second pumping chamber in the housing.

8. The system of claim 2 wherein the cryogenic fluid storage vessel further includes each of a service port and a cold well formed therein, and wherein the pumping system is mounted within the fluid storage vessel adjacent to the service port and the system further comprises a second pumping system positioned at least partially within the cold well.

9. The system of claim 2 further comprising a pressure venting conduit coupled to the cooling jacket, and a pressure relief valve within the pressure venting conduit.

10. A machine system comprising:

a machine;

a storage vessel structured to contain a fluid;

fluid coupling hardware including a fluid conduit for conveying the fluid in a gaseous or liquid form from the storage vessel to the machine; and a pumping system positioned within the storage vessel, and including a housing having a pumping inlet, a pumping outlet structured to fluidly connect with the fluid conduit, and a pumping chamber;

the pumping system further including a pumping element movable within the pumping chamber to transition the fluid from the pumping inlet to the pumping outlet, and an electric drive structured to actuate the pumping element; and the pumping system further including a cooling jacket forming a heat exchange cavity about the electric drive for conveying the fluid in heat transference contact with the electric drive;

wherein the cooling jacket is disposed separately from the pumping chamber and the heat exchange cavity is positioned fluidly between the pumping inlet and the pumping outlet, such that the cryogenic fluid transitioned from the pumping inlet and pumping chamber is conveyed through the heat exchange cavity to exchange heat with the electric drive prior to being transitioned to the pumping outlet.

11. The system of claim 10 wherein the electric drive includes a linear electric motor having a fixed electromagnetic element and a movable electromagnetic element.

12. The system of claim 10 wherein the machine includes an internal combustion engine.

13. The system of claim 10 wherein the fluid coupling hardware further includes a vaporizer for transitioning cryogenic fluid fuel stored in the storage vessel from a liquid state to a gaseous state for fueling the internal combustion engine.

14. The system of claim 13 wherein the fluid coupling hardware further includes an accumulator, coupled with the vaporizer and a second fluid conduit for conveying fluid from the accumulator to the machine.

15. The system of claim 10 wherein the pumping system includes a high-pressure pumping mechanism, and the pumping system further comprises a low-pressure pumping mechanism positioned within the storage vessel.

16. A method of operating a cryogenic fluid system comprising:

operating a pumping system submerged in cryogenic fluid within a storage vessel to transition the cryogenic fluid from the storage vessel to a fluid conduit outside the storage vessel that is structured to supply the fluid to a machine, the pumping system including a pumping chamber in which the cryogenic fluid is pumped;

conveying the cryogenic fluid transitioned by way of the operating of the pumping system so that the cryogenic fluid pumped in the pumping chamber is conveyed through a heat exchange cavity formed by a cooling jacket positioned about an electric drive of the pumping system, such that the cryogenic fluid exchanges heat with the electric drive, wherein the cooling jacket is disposed separately from the pumping chamber; and conveying the cryogenic fluid having exchanged heat with the electric drive out of the storage vessel.

17. The method of claim 16 wherein the operating of the pumping system further includes operating a linear motor of the pumping system to reciprocate a piston within the pumping chamber in the pump housing.

18. The method of claim 16 wherein the conveying of the cryogenic fluid further includes conveying the cryogenic fluid from the heat exchange cavity to the fluid conduit outside the storage vessel in isolation from contact with any bearing surfaces of the linear motor and any bearing surfaces of the piston.

* * * * *